US006373035B1

(12) United States Patent
Okamoto et al.

(10) Patent No.: US 6,373,035 B1
(45) Date of Patent: Apr. 16, 2002

(54) INDUCTION-HEATING ROLLER DEVICE

(75) Inventors: Kozo Okamoto; Yoshihiko Yamamura, both of Kyoto (JP)

(73) Assignee: Tokuden Co., Ltd., Kyoto (JP)

( * ) Notice: Subject to any disclaimer, the term of this patent is extended or adjusted under 35 U.S.C. 154(b) by 0 days.

(21) Appl. No.: 09/884,104

(22) Filed: Jun. 20, 2001

(30) Foreign Application Priority Data

Jun. 21, 2000 (JP) ..... 2000-185686

(51) Int. Cl.[7] ..... H05B 6/14
(52) U.S. Cl. ..... 219/619; 219/660; 219/469
(58) Field of Search ..... 219/619, 647, 219/652, 469, 470, 471, 660, 661, 663; 492/7, 16, 46

(56) References Cited

U.S. PATENT DOCUMENTS 3,582,615 A * 6/1971 Schippers et al. ..... 219/471
5,393,959 A * 2/1995 Kitano et al. ..... 219/619
5,553,729 A * 9/1996 Kitano et al. ..... 219/619

FOREIGN PATENT DOCUMENTS

JP 3-241688 * 10/1991 ..... 219/619

* cited by examiner

*Primary Examiner*—Philip H. Leung
(74) *Attorney, Agent, or Firm*—Morgan, Lewis & Bockius LLP

(57) ABSTRACT

A relay box is fastened to the end of a support rod supporting an induction heating mechanism, which the end is extended outside. Receptacles of connectors are mounted on a surface of the relay box. Lead wires connected to the induction coils are connected to the receptacles. Plugs are removably pin-connected to the receptacles. Power lines connecting to the exciting power source are connected to the plugs.

4 Claims, 5 Drawing Sheets

INDUCTION-HEATING ROLLER DEVICE

BACKGROUND OF THE INVENTION

The present invention relates to an induction-heating roller device.

There is known an induction-heating roller device having a rotary roller shell and an induction heating mechanism including an iron core and induction coils wound on the iron core. The induction-heating roller device is constructed as shown in FIG. 5. In the figure, reference numeral 1 is a roller shell, and numeral 2 indicates journals integrally formed on both sides of the roller shell. The roller shell is rotatably supported on a frame 4 with the aid of bearings 3, and is driven to rotate.

An induction heating mechanism 5 is supported by a support rod 6 within the roller shell 1. The support rod 6 is inserted into the journals 2, and supported by the same with bearings 7 inserted therebetween. The induction heating mechanism 5 is formed with a cylindrical iron core 8 and a plurality of induction coils 9 which are wound on the iron core while being arrayed side by side. Induction coils 9 are connected to an AC power source (not shown), located outside, by way of lead wires 10. A jacket chamber 11 filled with a two-phase (gas and liquid) heating medium is provided on the inner wall of the roller shell 1.

Reference numeral 12 is a refrigerant supply pipe 12 for cooling the induction heating mechanism 5 including the iron core 8 and the induction coils 9. Reference numeral 13 is cooling pipes 13 which are attached to the inner side of the iron core 8 and supplied with a refrigerant from the refrigerant supply pipe 12. The cooling pipes 13 are successively coupled with one another by coupling pipes 14. Reference numeral 15 is a discharge pipe through which the refrigerant is discharged from the cooling pipes 13. A dry air supply pipe 16 supplies dry air to prevent dew condensation from forming on the cooled induction heating mechanism 5. Auxiliary induction coils 17 are disposed on both sides of the induction coils 9 arranged side by side.

To connect the induction coils 9 of the thus constructed induction-heating roller device to the exciting power source, the lead wires 10 are connected to both ends of each induction coil, and led out of the inside of the roller shell 1. The lead wires led out are connected to the exciting power source outside the roller shell 1. In this case, the lead wires 10, as shown in FIG. 5, are led out from the end of the support rod 6.

Where the lead wires 10 are led out from the end of the support rod, when the induction-heating roller device after manufactured is removed from the frame 4, and hoisted with a crane or the like, the lead wires 10 hang down from the end of the support rod 6. Sometimes, the induction-heating roller device being craned loses its balance. When the induction-heating roller device is moved by the crane, the operator must carefully manipulate the crane so that the lead wires 10 hanging down do not hit another object on the floor.

When the bearings 7 are replaced in the induction-heating roller device after assembled, the bearings 7 removed from the journals 2 must be pulled out of the lead wires 10. The lead wires 10 are usually about 5 m to 7 m long. Work to pull the bearings 7 from such long lead wires 10 is troublesome. In any case, it is difficult to dispose of the lead wires 10 led out of the support rod 6.

SUMMARY OF THE INVENTION

Accordingly, an object of the present invention is to provide an induction-heating roller device improved such that the lead wires necessary for connecting the induction coils to the exciting power source do not hinder the transporting of the device or other work, and the device handling is simple and easy.

To achieve the above object, there is provided an induction-heating roller device having a rotary roller shell and an induction heating mechanism including an iron core and induction coils wound on the iron core, wherein a relay box is fastened to the end of a support rod supporting the induction heating mechanism, which the end is extended out of the roller shell, receptacles of connectors to which lead wires connected to the induction coils are connected are mounted on a surface of the relay box, and power lines connecting to the exciting power source are connected to the plugs removably coupled to the receptacles.

The lead wires connecting to the induction coils are connected to the receptacles provided on the relay box. Accordingly, to connect the exciting power source to the induction coils, what an operator has to do is to merely insert the plugs into the receptacles of the connectors. Accordingly, when the plugs are pulled out of the connectors, there is no chance that the lead wires are pulled out of the support rod and hang down. Accordingly, the lead wires do not hinder the handling of the induction-heating roller device, for example, device transportation. In other words, the handling is extremely easy.

In addition to this, the above-mentioned object can also be achieved by an induction-heating roller device, according to the present invention, comprising:

a rotary roller shell;

an induction heating mechanism housed in the rotary roller shell, the induction heating mechanism including an iron core and induction coils wound on the iron core; and a support rod supporting the induction heating mechanism and having one end extended out of the rotary roller shell;

a relay box fastened to the end of the support rod, wherein the relay box includes receptacles which are mounted on a surface of the relay box and are connected to the induction coils through lead wires respectively, and the receptacles are respectively and removably coupled from the outside of the relay box with plugs which are connected to an exciting power source through power lines respectively.

In the above-mentioned induction-heating roller device according to the present invention, it is advantageous that the plugs are disposed in a staggered manner.

Further, in the above-mentioned induction-heating roller device according to the present invention, it is also advantageous that the plugs are distributed at substantially predetermined interval in a circumferential direction of the relay box.

Furthermore, in the above-mentioned induction-heating roller device according to the present invention, it is also advantageous that the relay box has a plurality of steps on which the plugs are provided, while the axes of the plugs are dispersed in the radial direction of the relay box.

DETAILED DESCRIPTION OF THE PREFERRED EMBODIMENTS

Figure 1:
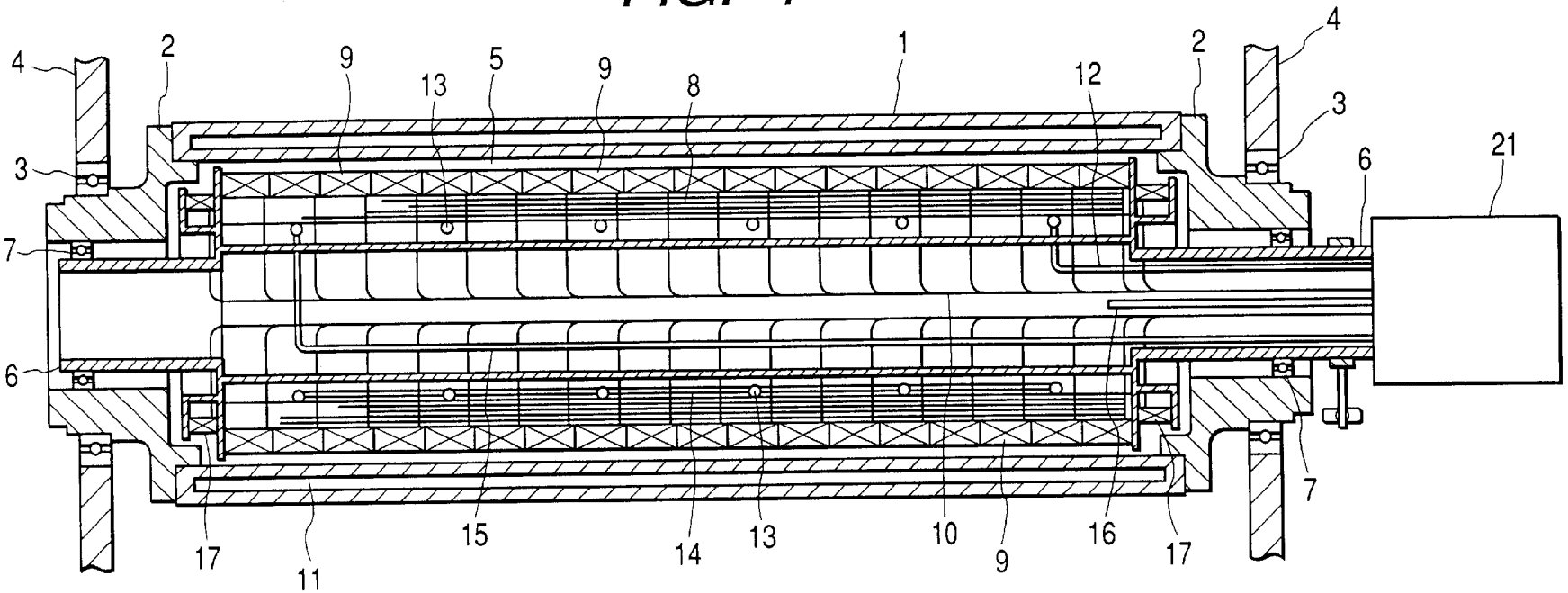
FIG. 1 is a cross sectional view showing an induction-heating roller device according to an embodiment of the present invention.
Figure 2:
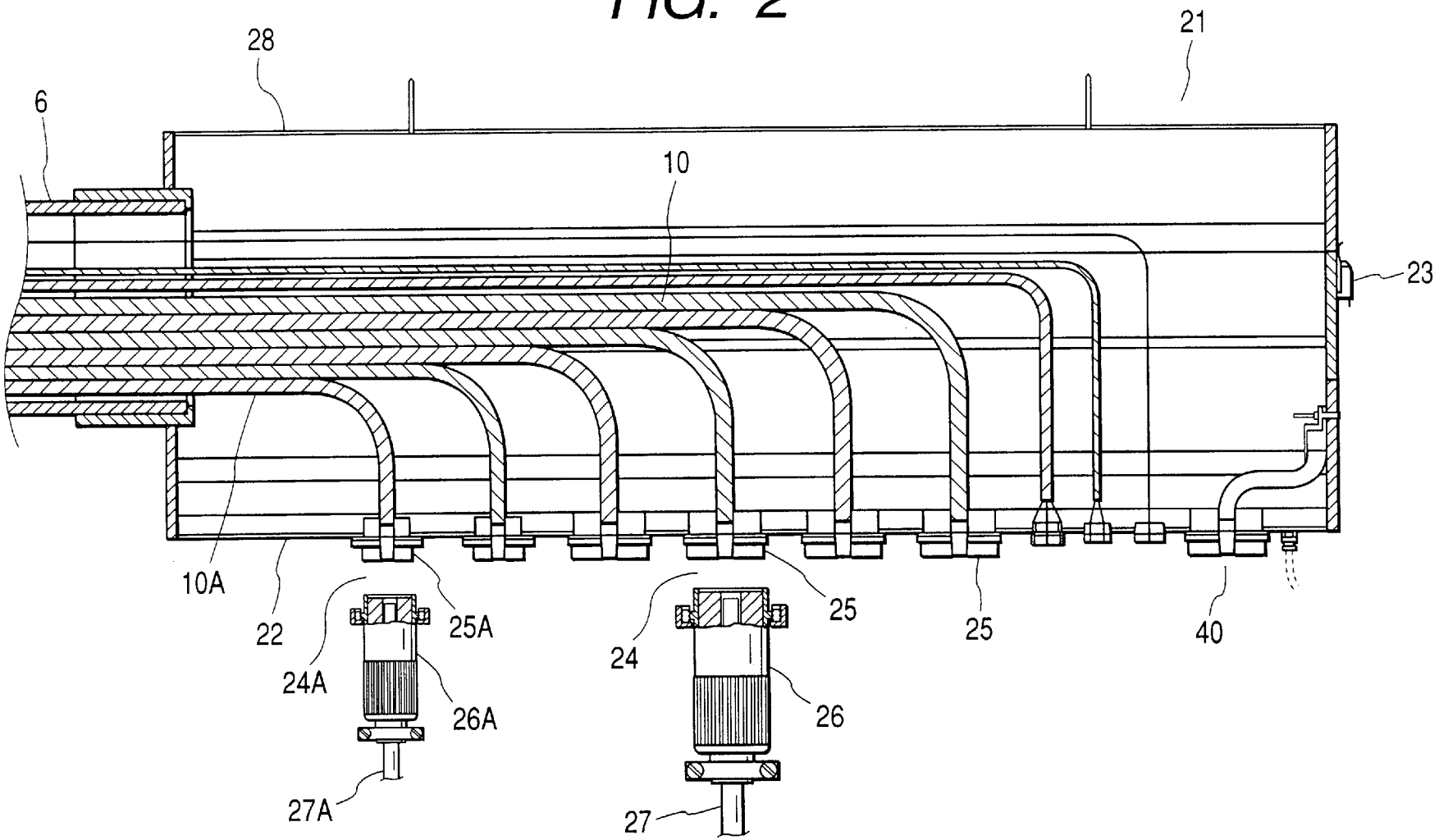
FIG. 2 is an enlarged sectional view showing a part of the induction-heating roller device of FIG. 1.
Figure 5:
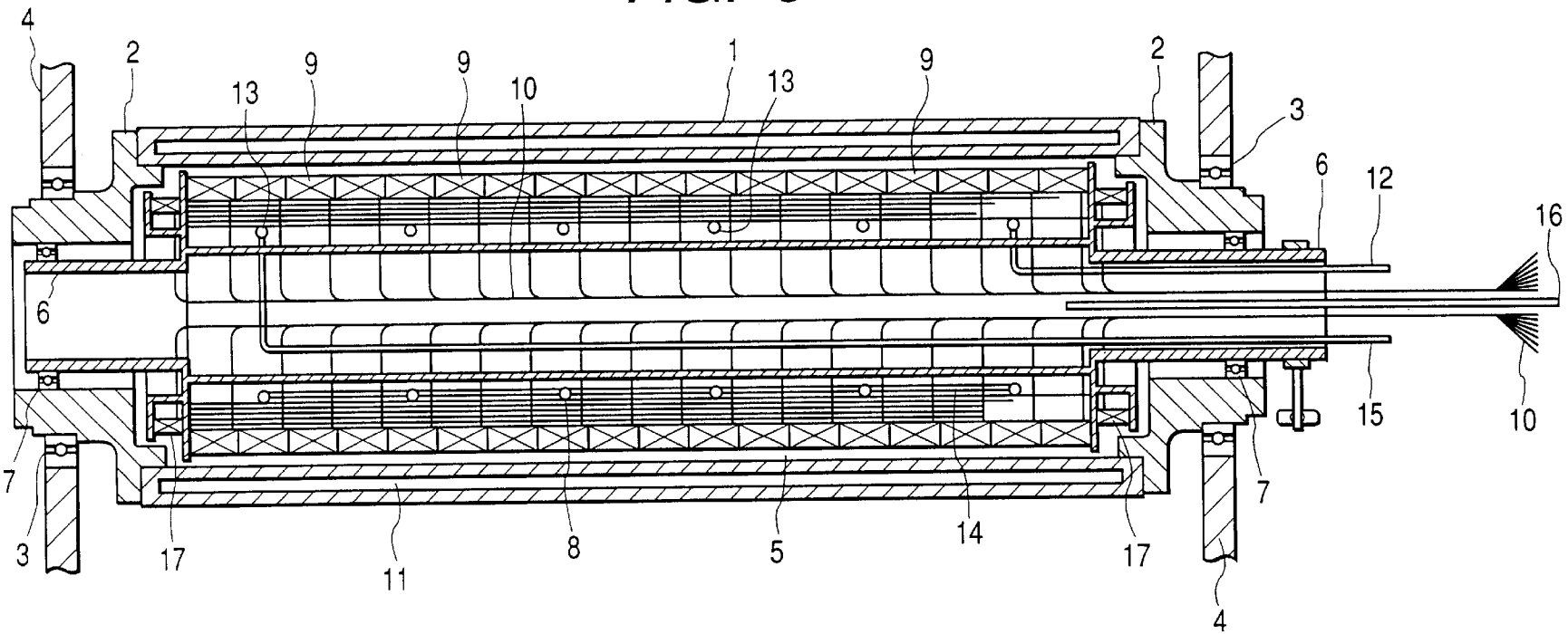
FIG. 5 is a cross sectional view showing a conventional induction-heating roller device.

The preferred embodiment of the present invention will be described with reference to FIG. 1 and the subsequent ones. Like or equivalent portions are designated by like reference numerals in FIG. 5. A relay box 21 is fastened to the end of a support rod 6, which is protruded out of a roller shell 1. The relay box 21 is formed with a box body 22 and a cover member 28 that is hingedly mounted on the box body by a hinge 23 to open and close.

Lead wires 10 led out of the support rod 6 are introduced into the relay box 21. Receptacles 25 of a plurality of connectors 24 are mounted on a surface of the box body 22. The lead wires 10 of induction coils 9 that are introduced into the relay box 21 are connected to the receptacles 25. The connection is carried out after the cover member 28 is opened and the inside of the box body 22 is put in an accessible state.

Figure 4:
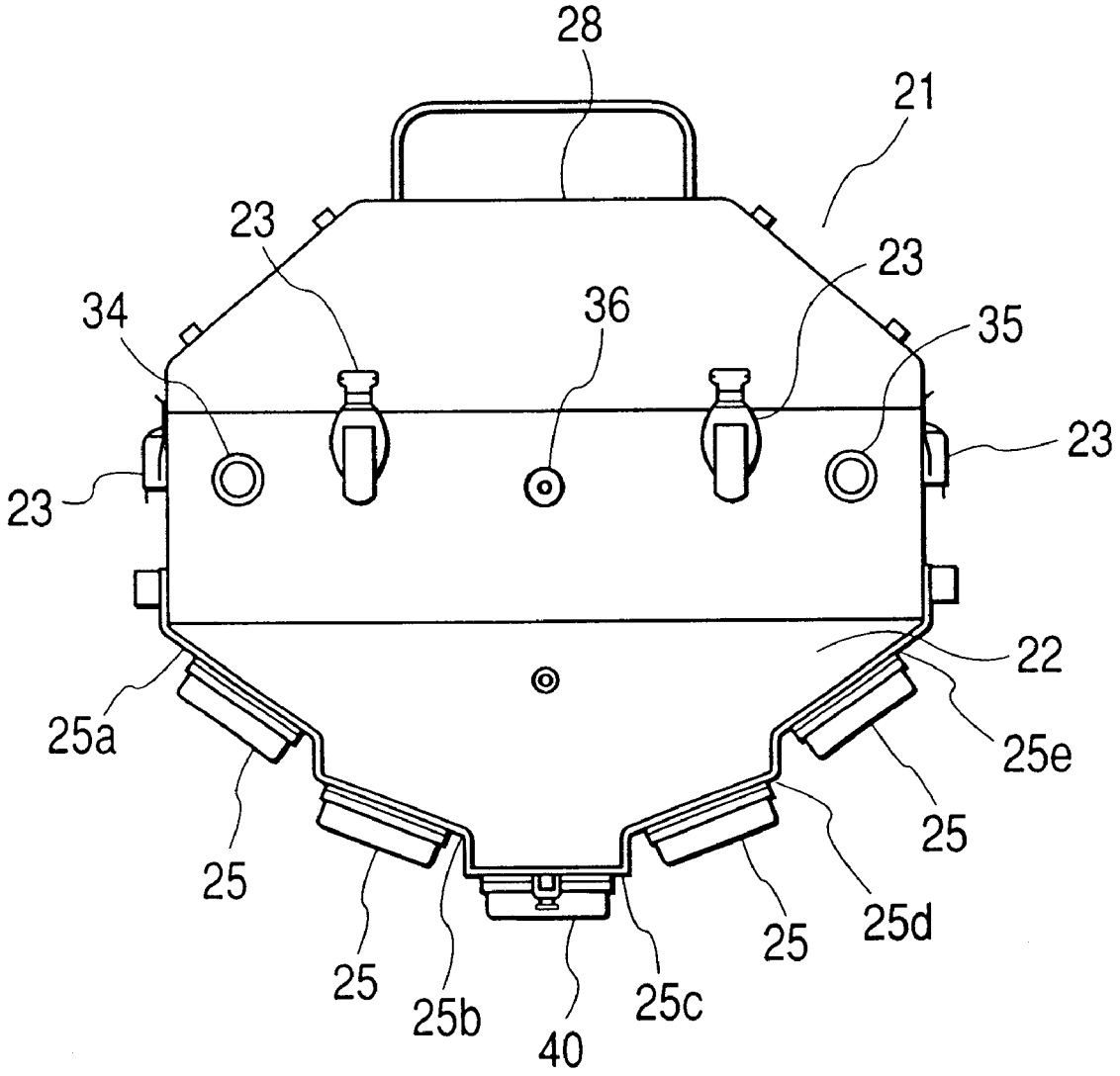
FIG. 4 is a side view of the FIG. 1 device.

Note that as shown in FIG. 4, the receptacles 25 are distributed at substantially predetermined interval in a circumferential direction of the relay box 21 with steps 25*a* to 25*e*. In addition to this, the center axes of the receptacles 25 are dispersed from one another in a radial direction of the relay box 21 substantially. Accordingly, it is possible to prevent the interference between the plugs 26 which are connected to the receptacles 25, while the relay box 21 is kept compact in size.

Figure 3:
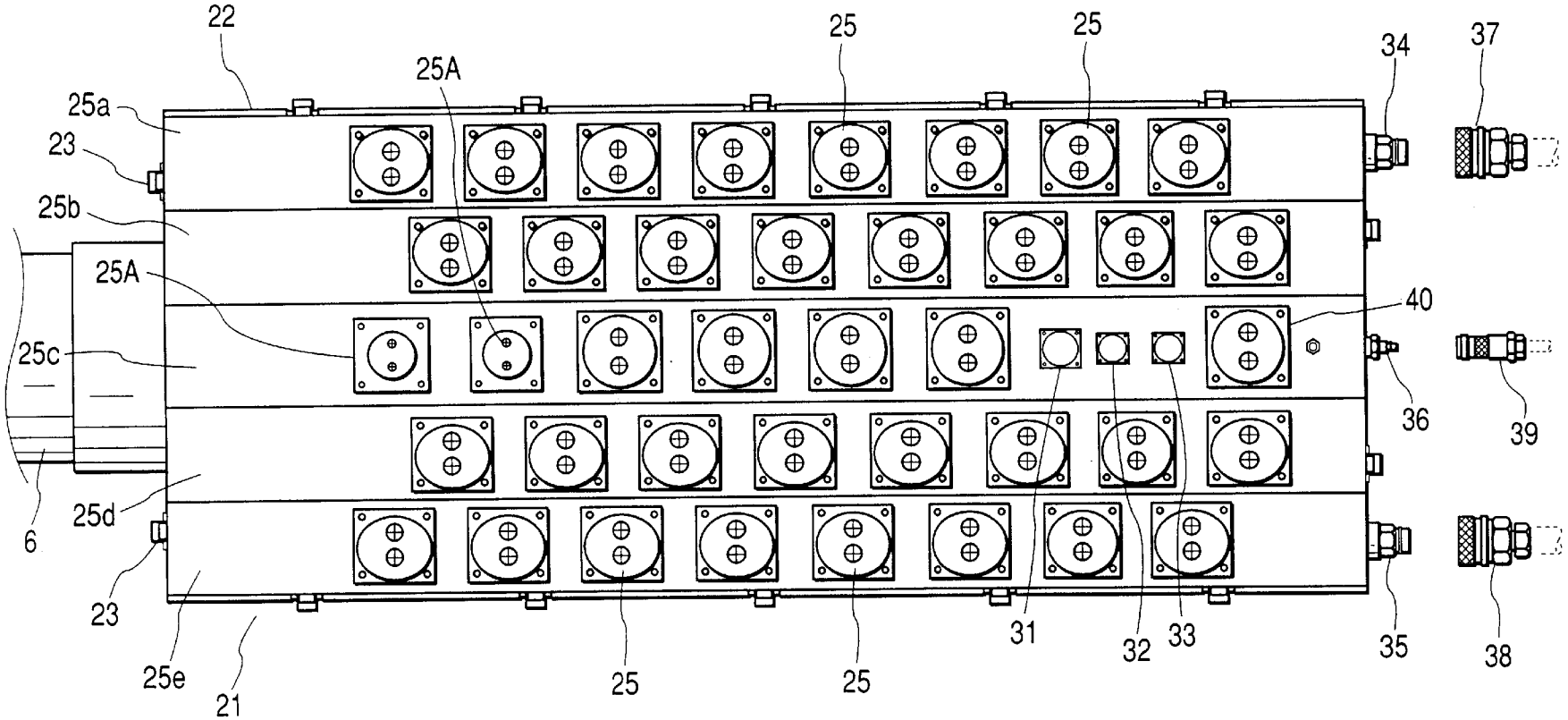
FIG. 3 is a bottom view of the device part of FIG. 2.

Further, as shown in FIG. 3, the receptacles 25 are disposed in a staggered manner in order to prevent the interference between the plugs 26 which are connected to the receptacles 25, to thereby reduce the size of the relay box 21.

In the illustrated instance, one receptacle 25 is provided for one lead wire 10. A plug 26 is inserted from the outside of the relay box 21 into each receptacle 25 to set up a pin connection. The plug 26 is connected to an exciting power source through a power line 27. Accordingly, the induction coils 9 are connected through the connector 24 to the exciting power source.

In a state that the plug 26 is pulled out of the receptacle 25, the induction coils 9 are disconnected from the exciting power source. In this state, the lead wires 10 remains connected to the receptacle 25. However, neither the lead wires nor the power lines are led out of the relay box 21. Accordingly, when the induction-heating roller device including the roller shell 1 is craned up or transported, no lead wires hang down from the device. As a result, the craning or transporting work becomes easy.

When the bearings 3 or bearing 7 are removed for its replacement, either of the following manners may be employed. When the relay box 21 is smaller than the bearings 3 or 7 to be within the bearing diameter, the bearings 3 or 7 are merely pulled out of the relay box 21. When the relay box 21 is larger than the bearings 3 or 7, the lead wires 10 are removed from the receptacle 25, the relay box 21 is pulled out of the support rod 6, and then the bearings 3 or 7 are removed.

Where as shown, auxiliary induction coils 17 are used because of necessity of its use, its lead wire 10A is connected another receptacle 25A provided in the relay box 21, and are connected to the exciting power source by way of a power line 27A connected to a plug 26A to be inserted.

Even when a situation demands the sending of output signals from temperature sensors associated with the induction coils 9, the bearings 7 and the exit of a discharge pipe 15 to exterior, the electric wire used for the sending of the output signal may disconnectively be connected to the induction-heating roller device by the utilization of receptacles 31, 32, 33 attached to the relay box 21.

Receiving plugs 34, 35, 36 may be attached to the relay box 21, which the plugs connect to the ends of a refrigerant supply pipe 12, a refrigerant discharging pipe 15, and a dry air supply pipe 16. In this case, insertion plugs 37, 38, 39 connecting a refrigerant source, a refrigerant discharging pipe, and a dry air source, which are inserted into the receiving plugs when necessary, are provided. By so doing, the tube members connecting to the refrigerant source, the refrigerant discharging pipe, and the dry air source may removably be coupled to the induction-heating roller device. Reference numeral 40 designates a ground receptacle which is also mounted on the relay box 21.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

As seen from the foregoing description, in the present invention, the lead wires connected to the induction coils are connected to an external exciting power source. Connectors are attached to a relay box mounted on the end of the support rod. The lead wires are connected to the connectors. Plugs to which power lines are connected are removably connected to the connectors. Accordingly, in a state the plugs are pulled out, the lead wires are located outside the induction-heating roller device. Therefore, the handling of the induction-heating roller device is extremely easy.

What is claimed is:

1. An induction-heating roller device comprising:

a rotary roller shell;

an induction heating mechanism housed in said rotary roller shell, said induction heating mechanism including an iron core and induction coils wound on said iron core; and a support rod supporting said induction heating mechanism and having one end extended out of said rotary roller shell;

a relay box fastened to the end of said support rod, wherein said relay box includes receptacles which are mounted on a surface of said relay box and are connected to said induction coils through lead wires respectively, and said receptacles are respectively and removably coupled from the outside of said relay box with plugs which are connected to an exciting power source through power lines respectively.

2. The induction-heating roller device according to claim 1, wherein said plugs are disposed in a staggered manner.

3. The induction-heating roller device according to claim 1, wherein said plugs are distributed at substantially predetermined interval in a circumferential direction of said relay box.

4. The induction-heating roller device according to claim 3, wherein said relay box has a plurality of steps on which said plugs are provided, while the axes of said plugs are dispersed in the radial direction of said relay box.

* * * * *